United States Patent [19]

Cohen

[11] Patent Number: 4,982,659

[45] Date of Patent: Jan. 8, 1991

[54] FABRIC PRINTING IMPLEMENT

[76] Inventor: James D. Cohen, 305 Newtown Rd., Wyckoff, N.J. 07481

[21] Appl. No.: 377,752

[22] Filed: Jul. 5, 1989

Related U.S. Application Data

[63] Continuation of Ser. No. 870,150, Jun. 3, 1986, abandoned.

[51] Int. Cl.[5] ..... B41F 17/38; B41F 1/02

[52] U.S. Cl. ..... 101/287; 101/16; 101/35; 400/108

[58] Field of Search ..... 101/3, 12, 16, 17, 19, 101/26, 30, 32, 31, 35, 287, 324, 333, 368, 372, 405, 407; 400/108

[56] References Cited

U.S. PATENT DOCUMENTS

| | | | |
|---|---|---|---|
| 16,270 | 12/1856 | Evens, Jr. | 101/406 X |
| Re. 23,171 | 11/1949 | Borkland | 101/32 |
| 56,244 | 7/1866 | Weiden | 101/31.1 |
| 125,610 | 5/1872 | Olmsted . | |
| 1,167,727 | 1/1916 | Stevens | 101/405 |
| 1,563,124 | 11/1925 | Wald | 101/368 X |
| 1,565,951 | 12/1925 | Peters | 101/405 |
| 1,732,017 | 10/1929 | Jenkins | 101/327 |
| 1,892,754 | 1/1933 | Tarbox | 101/32 |
| 2,009,414 | 7/1935 | Roberts | 101/31 |
| 2,327,762 | 10/1939 | Bull | 101/32 |
| 2,535,642 | 12/1950 | Liebowitz | 101/297 |
| 2,839,993 | 6/1958 | Orthwin | 101/368 |
| 3,260,192 | 7/1966 | Ostenburg | 101/405 |
| 3,376,812 | 10/1965 | Sterling | 101/324 |
| 3,584,572 | 6/1971 | Apicella | 101/24 |
| 4,574,693 | 3/1986 | Fink et al. | 101/3.1 |
| 4,760,788 | 8/1988 | Marozzi et al. | 101/333 |

FOREIGN PATENT DOCUMENTS

| | | | |
|---|---|---|---|
| 0215868 | 12/1984 | Japan | 101/31 |

*Primary Examiner*—Edgar S. Burr
*Assistant Examiner*—John S. Hilten

[57] ABSTRACT

A fabric printing implement has a U-shaped, flexible support which carries at the ends of the "U" a printing head and an anvil. The printing head is formed of a recessed printing surface, and the anvil is formed of a tapered surface. The combination of the tapered surface of the anvil and the recess of the printing head operates such that the cloth or fabric being imprinted is stretched to remove wrinkles and present a flat surface so that the printing can be clear and legible. The arms of the "U" are formed of such size that cloth can be gathered between the arms to present almost any desired location on the cloth for imprinting between the anvil and the printing head.

4 Claims, 1 Drawing Sheet

FABRIC PRINTING IMPLEMENT

This is a continuation of application Ser. No. 870,150, filed on June 3, 1986, now abandoned.

BACKGROUND OF THE INVENTION

1. Field of the Invention

The present invention relates to a portable, hand-held device which can mark or imprint fabric with a name or other legend or message and can be utilized by a laundry, other commercial enterprises, or principally, at home, to mark children's clothing with their name or identifying mark so that they can distinguish their own from other fabric articles of other children.

2. Description of the Prior Art

U.S. Pat. No. 930,005 to Weaver et al. discloses a clothes marking device which operates generally in a manner similar to that of a pliers. Specifically, the letters to be imprinted on the garment are set in a manner analagous to the setting of type, the letters are inked utilizing an ink pad and then the fabric is inserted between the letters and a smooth surface backer plate. The handles of the plier-like device are squeezed together forcing the letters against the fabric between the letters and the backer plate. The device of Weaver et al. is characterized by its complexity in its number of interconnecting moving parts and in the fact that inking of the letters is required as a separate step for the device to be utilized.

Webster, U.S. Pat. No. 909,836, discloses a device for imprinting seals on paper and utilizes a "U"-shaped support for suspending an imprinting seal above an anvil. The Webster device does not rely on any flexing of the "U"-shaped support for imprinting the seal on paper; rather, Webster has a handle, pivotally mounted, to drive the seal against the anvil via the relationship between the underside of the handle and the stem of the support for the seal.

Other patents show various devices for manually imprinting. Baskerville, U.S. Pat. No. 1,370,267, shows a hinged support for imprinting letters against a inking pad carried by a base plate. The Baskerville device is utilized in verifying freight loads by a loading clerk utilizing a loading ticket marked with the device.

U.S. Pat. Nos. 1,634,105 to Hoffman and 3,129,660 to Miller disclose flat portable printers which record information on paper so as to function as a check protector or as a pocket secretary, respectively. The U.S. Pat. Nos. 1,665,597 to Marks and 2,482,542 to Hanrahan, et al. disclose imprinting devices operating in a manner analagous to a stapler where a fixed base has a spring-loaded arm pivotally mounted at one end thereof. Imprinting is obtained by manually forcing the moveable arm against the fixed base with the desired media there between. U.S. Pat. No. 2,443,783 to Bogin, et al. shows a printing kit where the supporting box carrying the various kit elements also shows as the cover and platen for the printing process itself.

SUMMARY OF THE INVENTION

The invention consists of a U-shaped support member having a co-acting stamp head and anvil at the ends of the "U". The length of the arms of the "U" are made long enough so that cloth can be gathered in the recess of the "U" to enable the location for the stamping or imprinting to be easily positioned to the desired location on the clothing. The stamp head is formed with the letters being recessed below the outer rim of the stamp head. This recessing of the letters requires that the cloth stretch in order to be imprinted. This stretching thus ensures that the image stamped on the cloth will be clear and not wrinkled as the stretching causes the cloth to flatten and wrinkles are eliminated. The anvil element is shaped such that it will fit within the recess and is also tapered in its working surface so as to compensate for the width of the "U" to ensure both the cloth being flattened and a flat backing surface being available at the printing stamp.

The flexibility of the "U"-shaped support allows limited outward spreading of the arms of the "U" to further ensure ease in insertion of the fabric. The printing pad itself is pre-inked so that the need for separate inking of the print is removed.

It is a principal object of the invention to provide a device for marking and imprinting a cloth.

An important object of the invention is the provision of a cloth imprinting device which contains a mechanism to ensure that the cloth is stretched to present a flat, wrinkle-free surface for the imprint so that the imprint will be clear and not distorted.

An important object of the present invention is the provision of a clothing printing device which has a pre-inked pad and does not require the use of separate ink, or inking, for operation.

A further object of the present invention is the provision of a recess in the print carrying portion of the device so as to flatten the cloth before printing occurs.

Another object of the present invention is the provision of a cloth printing device which can be used in the home.

A further object of the present invention is the provision of a device which has no moving parts and can be manufactured simply and can be utilized by anyone without any special skill, training or without the need for any preparation of the device or the fabric to be imprinted.

A further object of the present invention is the provision of a fabric printing device which has sufficient space so that the cloth can be gathered within the device to enable printing any location on the fabric.

These, as well as further objects and advantages of the invention, become apparent to those skilled in the art from review of the following specification reference being made to the accompanying drawings in which:

BRIEF DESCRIPTION OF THE DRAWINGS

FIG. 1 shows the device generally at reference numeral 10. The anvil or base support is designated by 16. The printing head is shown at 18. Both the anvil and the printing head are mounted at opposite ends of a flexible "U"-shaped support 40. The bottom arm of the "U", as seen in FIG. 1, is denoted by numeral 24, and the top of the "U" is denoted by numerals 12 and 14. Numerals 12 and 14 denote two tapered surfaces on the top of the "U". These surfaces taper from a center line 38. Both the taper and the line 38 continue around the U-shaped support from the top, as shown in FIG. 1, to the bottom, as seen in FIG. 3. The taper is provided for structural integrity and to better grip and utilize the device.

Figure 1:
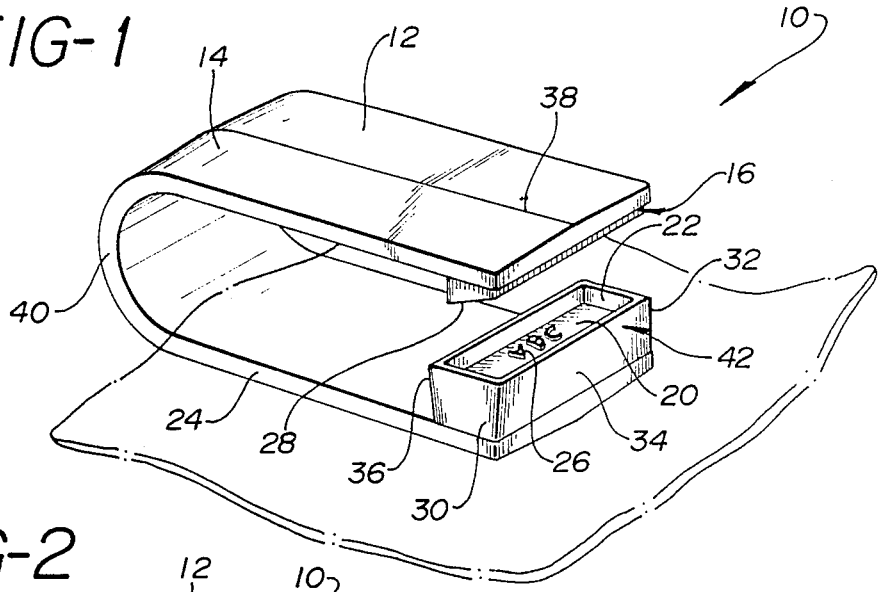
FIG. 1 is a perspective view of the fabric imprinting device.

The anvil support 16 has a tapered working surface 28 formed thereon. The surface 28 is tapered because, in operation of the device, squeezing of the ends of the "U" causes the anvil to be brought into contact with the print head 18 and the taper 28 compensates for the travel in the arcuate path required to bring the anvil into engagement with the print head.

The print head 18 has a pre-inked printing pad 26 mounted therein. The print pad 20 is mounted below the upper ends of head 18, such that a recess 22 is formed. Recess 22, formed by the rim of the print head housing shown generally at 42, has a depth such that the fabric will be stretched flat in operation of the device when the fabric contacts the pre-inked pad 20. A fragment of cloth is shown in the phantom linework.

Figure 2:
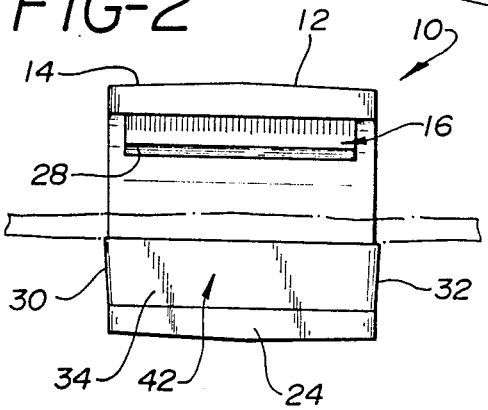
FIG. 2 is an end view of the device.
Figure 3:
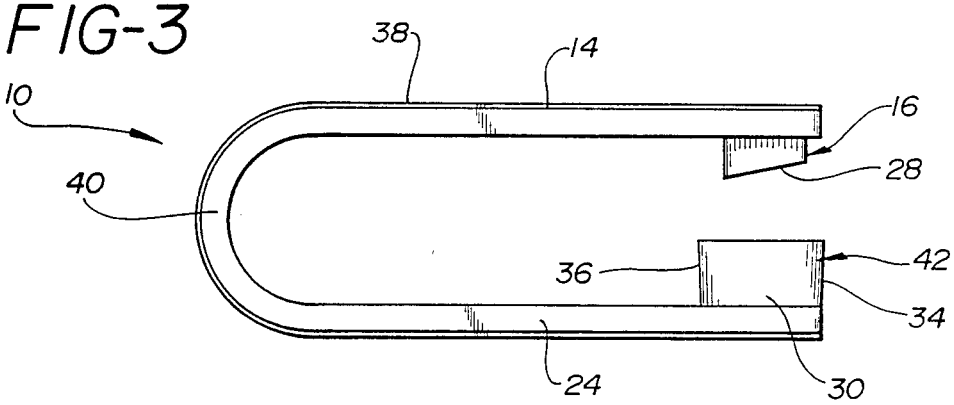
FIG. 3 is a side-view of the device.

As seen in the end view of FIG. 2, additional tapered surfaces 30 and 32 are formed at the ends of print head 18. As seen in FIG. 3, the longitudinal walls 34 and 36 of print head 18 are also similarly tapered. The taper is such that the four walls of the print head 30, 32, 34 and 36 extend upward from the bottom portion of the "U" 24 outwardly and upwardly to form the housing 18 for the pre-inked pad 20. These tapered surfaces co-act with the anvil 16, the recess 22 and the cloth to stretch same before it is imprinted between the pre-inked pad 26 and the tapered surface 28 of the anvil 16.

Figure 2A:
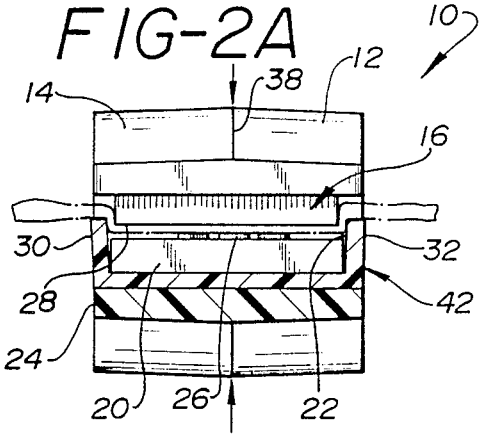
FIG. 2A is similar to FIG. 2, but shows the device in its imprinting position.

In operation, the device is sold with a variety of replaceable pre-printed ink-pads 20. In this way, the user can select one of a number of pre-packaged messages or popular names for use. In addition of course, any desired custom message can be generated for the user at the factory. Simply, the cloth to be imprinted is inserted into the device with unused cloth gathered within the arms of the "U" so that the desired location of the cloth to be printed is presented over the upper surface of print head 18. The device is squeezed together with anvil 16 forced into recess 22, thereby stretching the cloth and forcing it to contact the letters 26 on pad 20, as seen in FIG. 2A.

As modifications to the foregoing may be made without departing from the spirit and scope of my invention, what is desired to be covered by United States Letters Patent set forth in the appended claims.

I claim:

1. A fabric imprinting implement comprising:

a flexible frame having first and second interior surfaces formed therein;

a tapered support surface formed on said first interior surface for engaging fabric to be imprinted;

a working surface having indicia thereon formed on said second interior surface; opposite to said tapered support surface;

said working surface being formed within a housing affixed to said second interior surface, said housing extending upwardly from said second interior surface and having tapered fabric support walls extending outwardly from said second interior surface and above said working surface, said working surface being located in a recess in said housing formed by said fabric support walls opposite said tapered support surface, whereby said working surface and said support surface move into and out of engagement with each other on manipulation of said frame.

2. The device of claim 1 wherein said working surface is a pre-inked pad.

3. A fabric marking device comprising:

a unitary support having first and second interior surfaces formed thereon;

an anvil fabric support surface formed on said first interior surface;

a housing having a recess therein formed on said second interior surface opposite said anvil fabric support surface;

a printhead mounted in said recess for engagement with said anvil; and said recess being surrounded by fabric stretching surfaces.

4. The device of claim 3 wherein said fabric stretching surfaces are formed at an angle relative to said print head, said anvil extending from said first interior surface at an angle so as to interfit within said recess in said housing and flatten and stretch said fabric against said print head.

* * * * *